US009816406B2

(12) United States Patent
Choi

(10) Patent No.: US 9,816,406 B2
(45) Date of Patent: Nov. 14, 2017

(54) MULTIPLE VARIABLE VALVE LIFT APPARATUS

(71) Applicant: Hyundai Motor Company, Seoul (KR)

(72) Inventor: Byong Young Choi, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 26 days.

(21) Appl. No.: 14/865,906

(22) Filed: Sep. 25, 2015

(65) Prior Publication Data

US 2016/0363011 A1 Dec. 15, 2016

(30) Foreign Application Priority Data

Jun. 12, 2015 (KR) ..... 10-2015-0083556

(51) Int. Cl.
*F01L 1/344* (2006.01)
*F01L 1/12* (2006.01)
(Continued)

(52) U.S. Cl.
CPC ..... *F01L 1/344* (2013.01); *F01L 1/047* (2013.01); *F01L 1/053* (2013.01); *F01L 1/12* (2013.01); *F01L 1/18* (2013.01); *F01L 9/04* (2013.01); *F01L 13/00* (2013.01); *F01L 13/0005* (2013.01); *F01L 13/0036* (2013.01); *F01L 13/0042* (2013.01); *F01L 1/181* (2013.01); *F01L 1/185* (2013.01); *F01L 2001/0473* (2013.01); *F01L 2001/0476* (2013.01); *F01L 2013/001* (2013.01); *F01L 2013/0052* (2013.01);
(Continued)

(58) Field of Classification Search
CPC ..... F01L 2013/0052; F01L 13/0036; F01L 1/047; F01L 13/0042; F01L 13/00; F01L 1/18; F01L 1/12
USPC ..... 123/90.16, 90.15, 90.18
See application file for complete search history.

(56) References Cited

U.S. PATENT DOCUMENTS 7,322,327 B1 * 1/2008 Kim ..... F01L 1/053 123/90.16
7,938,091 B2 5/2011 Sagata

FOREIGN PATENT DOCUMENTS

DE 10148178 A1 * 4/2003 ..... F01L 1/053
JP 2007-032505 A 2/2007
(Continued)

OTHER PUBLICATIONS

DE 10148178 English Language Machine Translation.*

*Primary Examiner* — Mark Laurenzi
*Assistant Examiner* — Wesley Harris
(74) *Attorney, Agent, or Firm* — Morgan, Lewis & Bockius LLP

(57) ABSTRACT

A multiple variable valve lift apparatus may include a camshaft rotating by driving of an engine, a cam portion formed in a cylindrical shape having a hollow that the camshaft is inserted into, rotating together with the camshaft, configured to move along an axial direction of the camshaft, and forming a zero cam and a normal cam, a valve opening/closing device configured to be operated by at least one of the zero cam or the normal cam which are formed at the cam portion, an operating device disposed on an exterior circumference of the camshaft so as to move together with the cam portion, and a solenoid configured to selectively move the operating device along an axial direction of the camshaft, in which a journal, which has a radius being equal to a radius of the zero cam, is formed at the cam portion.

4 Claims, 2 Drawing Sheets

(51) Int. Cl.

| | |
|---|---|
| ***F01L 13/00*** | (2006.01) |
| ***F01L 1/18*** | (2006.01) |
| ***F01L 1/047*** | (2006.01) |
| ***F01L 9/04*** | (2006.01) |
| ***F01L 1/053*** | (2006.01) |

(52) U.S. Cl.
CPC ..... *F01L 2013/101* (2013.01); *F01L 2105/00* (2013.01); *F01L 2810/02* (2013.01)

(56) References Cited

FOREIGN PATENT DOCUMENTS

| | | | |
|---|---|---|---|
| JP | 4048582 | B2 | 2/2008 |
| KR | 10-1448784 | B1 | 10/2014 |

* cited by examiner

MULTIPLE VARIABLE VALVE LIFT APPARATUS

CROSS-REFERENCE TO RELATED APPLICATION

The present application claims priority to Korean Patent Application No. 10-2015-0083556 filed Jun. 12, 2015, the entire contents of which is incorporated herein for all purposes by this reference.

BACKGROUND OF THE INVENTION

Field of the Invention

The present invention relates to a multiple variable valve lift apparatus. More particularly, the present invention relates to a multiple variable valve lift apparatus to realize multiple valve lifts which includes zero lift.

Description of Related Art

Generally, an internal combustion engine receives fuel and air into a combustion chamber and generates power by combusting the fuel and the air. Herein, an intake valve is operated by drive of a camshaft, and air flows into the combustion chamber during when the intake valve is open. In addition, an exhaust valve is operated by drive of a camshaft, and air is exhausted from the combustion chamber while the exhaust valve is open.

Meanwhile, optimal operations of the intake valve or the exhaust valve are determined according to rotation speed of the engine. That is, lift and open/close timing of the valves are properly controlled according to rotation speed of the engine. A variable valve lift (VVL) apparatus has been developed in which the valves are operated for various lifts according to rotation speed of the engine for realizing optimal operations of the valves according to rotation speed of the engine. For example, there is a cam shift type variable valve lift apparatus in which a plurality of cams for operating the valves by each different lift are provided to the camshaft, and the cam operating the valves is selected according to conditions.

If a journal disposed between a cam and another cam is formed to be lengthy along axial direction for cam shift in a variable valve lift apparatus which is configured so that cams are arranged in parallel with each other for operating two valves, it is not easy that the variable valve lift apparatus is applied to a small engine having a narrow gap between two valves.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a multiple variable valve lift apparatus having advantages of providing a simple composition and being applied to an engine which has a narrow gap between two valves.

According to various aspects of the present invention, a multiple variable valve lift apparatus may include a camshaft rotating by driving of an engine, a cam portion formed in a cylindrical shape having a hollow that the camshaft is inserted into, rotating together with the camshaft, configured to move along an axial direction of the camshaft, and forming a zero cam and a normal cam, a valve opening/closing device configured to be operated by at least one of the zero cam or the normal cam which are formed at the cam portion, an operating device disposed on an exterior circumference of the camshaft so as to move together with the cam portion, and a solenoid configured to selectively move the operating device along an axial direction of the camshaft, in which a journal, which has a radius being equal to a radius of the zero cam, may be formed at the cam portion such that a cam cap surrounds an exterior circumference thereof.

The operating device may be formed in a cylinder shape having a hollow that the camshaft is inserted into.

A guide rail may be formed at the operating device by a groove shape to be extended along an external circumference, an operating pin, which is selectively contacted to the guide rail, may be disposed at the solenoid, and the guide rail may be configured to guide such that the operating device is moved along the axial direction of the camshaft as the camshaft is rotated on a state that the operating pin contacts the guide rail.

The cam cap may be positioned to surround an exterior circumference of the zero cam in a case that the valve opening/closing device is operated by the normal cam.

An oil passage may be formed at the cam cap so as to supply oil for lubrication to an exterior circumference of the journal.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
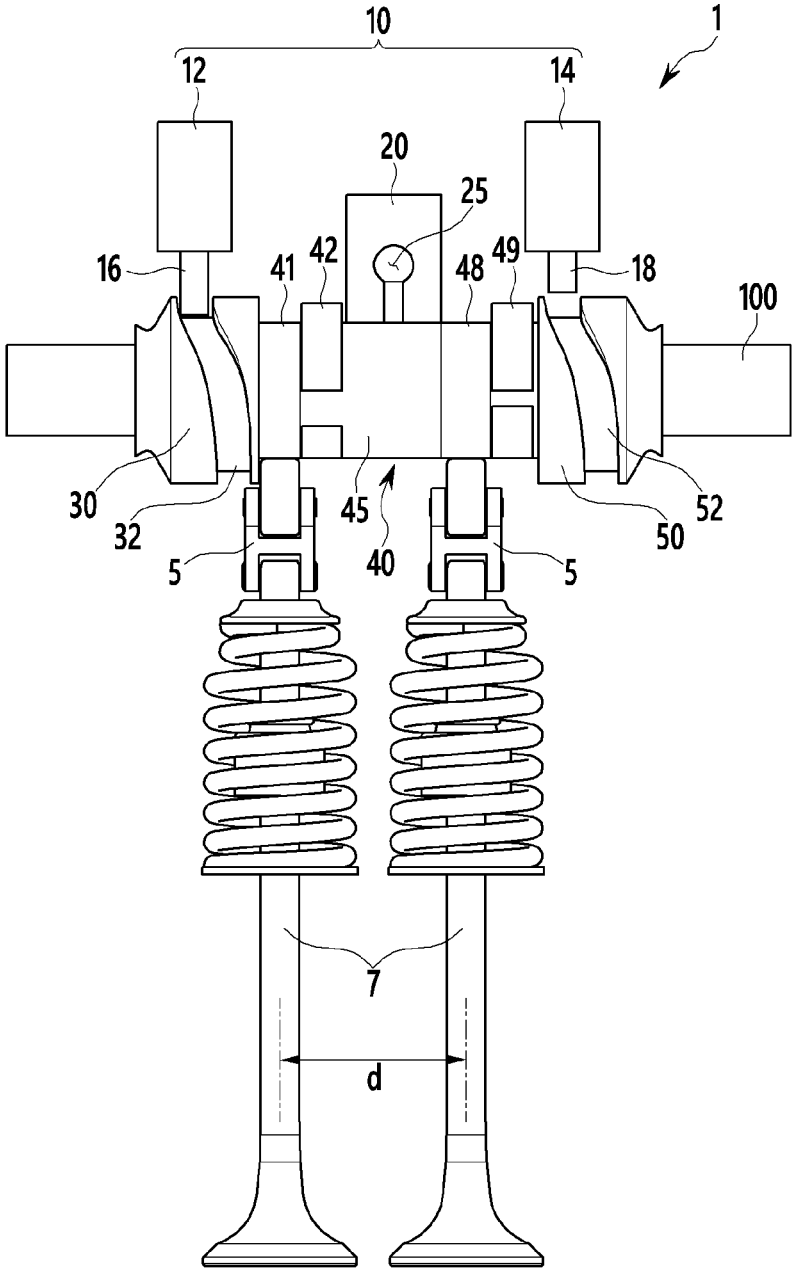
FIG. 1 illustrates an exemplary multiple variable valve lift apparatus according to the present invention on a state of realizing zero lift.

FIG. 1 illustrates a multiple variable valve lift apparatus according to various embodiments of the present invention on a state of realizing zero lift.

As shown in FIG. 1, a multiple variable valve lift apparatus 1 according to various embodiments of the present invention includes a camshaft 100, a cam portion 40, a solenoid 10, and operating devices 30 and 50.

The camshaft 100 is a shaft which is rotated by rotation of a crankshaft (not shown) of an engine. The camshaft 100 is well-known to a person of ordinary skill in the art such that a detailed description thereof will be omitted.

The cam portion 40 is a portion where cams 41, 42, 48, and 49 for operating an intake or exhaust valve 7 of an engine are formed, and is formed in a hollow cylinder shape having a set thickness. In addition, the camshaft 100 is inserted into the hollow of the cam portion 40. Thus, an entire shape of the cam portion 40 and the camshaft 100 is a shape such that the cam portion 40 protrudes from an exterior circumference of the camshaft 100. Herein, the hollow of the cam portion 40 mat be formed in a circular shape corresponding to an external circumference of the camshaft 100. That is, an interior circumference of the cam portion 40 contacts an exterior circumference of the camshaft 100. Further, an interior circumference of the cam portion 40 slides on an exterior circumference of the camshaft 100 such that the cam portion 40 is moved along an axial direction of the camshaft 100. The cam portion 40 is disposed to rotate together with the camshaft 100. The composition with which the cam portion 40 is movable along an axial direction of the camshaft 100 and the cam portion 40 and the camshaft 100 are coupled with each other such that the cam portion 40 and the camshaft 100 are rotated together can be realized by types such as using a spline according to design of a person of ordinary skill in the art.

The cam portion 40 is adapted to operate valves 7 disposed at one cylinder. In addition, the cam portion 40 can be provided for two valves 7 disposed at one cylinder. Herein, the valve 7 is the intake valve or the exhaust valve.

The cam portion 40 includes a first zero cam 41, a first normal cam 42, a second zero cam 48, a second normal cam 49, and a journal 45.

The first and second normal cams 42 and 49 realize normal lift that the valve 7 is repeatedly opened/closed by uniform lift depending on the cam 42 and 49. In addition, the first and second normal cams 42 and 49 may be formed in a general cam shape that an exterior circumference of a cut-plane is formed in an oval shape such that one end thereof is relatively further protruded to compare with the other end thereof. Typically, the one end of the cam is called "cam lobe", and the other end of the cam is called "cam base".

The cam base is a base circle of a cam, a part of an external circumference of the cam, which is formed in an arc shape having a uniform radius. In addition, the cam lobe is a part of an external circumference of the cam 42 and 49 which pushes the valve opening/closing device 5 from when opening of the valve is started to when closing of the valve is ended by rotation of the cam 42 and 49. Herein, the valve opening/closing device 5 is a device that one end thereof is rolling-contacted with the cams 41, 42, 48, and 49 so as to be operated to open/close the valves by the rotation of the cams 41, 42, 48, and 49. The valve opening/closing device 5, which may be a roller swing arm, is well-known to a person of an ordinary skill in the art such that a detailed description thereof will be omitted.

The first and second zero cams 41 and 48 realize zero lift that the valve 7 is not opened even though the cams 41 and 48 rotate. That is, the first and second zero cams 41 and 48 are formed in a circle shape having an uniform radius so as to form only cam base and do not form cam lobe.

That is, the normal lift of the valve 7 is realized when the valve opening/closing device 5 is connected to rolling-contact the normal cams 42 and 49, and the zero lift of the valve 7 is realized when the valve opening/closing device 5 is connected to rolling-contact the zero cams 41 and 48. In addition, the first and second normal cams 42 and 49 or the first and second zero cams 41 and 48 for operating the valve 7 are selected according to movement of the cam portion 40 along an axial direction of the camshaft 100.

The first zero cam 41 and the first normal cam 42 are formed to be close to each other, and the second zero cam 48 and the second normal cam 49 are formed to be close to each other. In addition, the first zero cam 41 and the first normal cam 42 are paired with each other so as to operate one valve 7, and the second zero cam 48 and the second normal cam 49 are paired with each other so as to operate the other valve 7.

The journal 45 connects the pair of the first zero cam 41 and the first normal cam 42 with the pair of the second zero cam 48 and the second normal cam 49. That is, the journal 45 is disposed between the pair of the first zero cam 41 and the first normal cam 42 and the pair of the second zero cam 48 and the second normal cam 49, and the cam portion 40 is integrally molded. Herein, the journal 45 is formed in a cylinder shape having a uniform radius, and the radius of the journal 45 is equal to the radius of the first and second zero cams 41 and 48.

The solenoid 10 is provided so as to transform rotational motion of the camshaft 100 to rectilinear motion of the cam portion 40. That is, the cam portion 40 is rectilinearly moved along an axial direction of the camshaft 100 according to rotational motion of the camshaft 100 if the solenoid 10 is operated. Herein, the solenoid 10 operated to on or off by electrical control of the solenoid 10 that is well-known to a person of ordinary skill in the art such that a detailed description thereof will be omitted.

The operating devices 30 and 50 are formed in a cylinder shape having a hollow like the cam portion 40, and the camshaft 100 is inserted into the hollow of the operating devices 30 and 50 such that the operating devices 30 and 50 are disposed on an exterior circumference of the camshaft 100. In addition, the hollow of the operating device 30 and 50 may be formed such that an internal circumference of the operating devices 30 and 50 corresponds to an external circumference of the camshaft 100. An external circumference of the operating devices 30 and 50 is formed in a circular shape having a uniform radius. Furthermore, an interior circumference of the operating devices 30 and 50 slides on an exterior circumference of the camshaft 100 such that the operating devices 30 and 50 are moved along an axial direction of the camshaft 100, and the operating devices 30 and 50 are adapted to rotate together with the camshaft 100. That is, the operating devices 30 and 50 are coupled with the camshaft 100 by types such as using a spline.

The solenoid 10 may be separated to a zero lift solenoid 12 and a normal lift solenoid 14, and the operating devices 30 and 50 may be separated to a zero lift operating device 30 and a normal lift operating device 50.

The zero lift operating device 30 is disposed at one end of the cam portion 40. In addition, the zero lift operating device 30 is integrally formed with the cam portion 40 or is provided to move together with the cam portion 40. Further, the zero lift operating device 30 rotating together with the camshaft 100 is moved in one direction along an axial direction of the camshaft 100 according to the operation of the zero lift solenoid 12. Thus, the zero lift of the valve is realized.

An operating pin 16 is disposed at the zero lift solenoid 12, and a guide rail 32 is formed at an external circumference of the zero lift operating device 30 by a groove shape to be extended along the external circumference. In addition, the guide rail 32 may be designed by a person of an ordinary skill in the art such that the zero lift operating device 30 moves toward one direction along an axial direction if the camshaft 100 rotates on a state that the operating pin 16 is inserted into the guide rail 32.

The normal lift operating device 50 is disposed at the other end of the cam portion 40. In addition, the normal lift operating device 50 is integrally formed with the cam portion 40 or is provided to move together with the cam portion 40. Further, the normal lift operating device 50 rotating together with the camshaft 100 is moved in one direction along an axial direction of the camshaft 100 according to the operation of the normal lift solenoid 14. Thus, the normal lift of the valve 7 is realized.

An operating pin 18 is disposed at the normal lift solenoid 14, and a guide rail 52 is formed at an external circumference of the normal lift operating device 50 by a groove shape to be extended along the external circumference. In addition, the guide rail 52 may be designed by a person of an ordinary skill in the art such that the normal lift operating device 50 moves toward the other direction along an axial direction if the camshaft 100 rotates on a state that the operating pin 18 is inserted into the guide rail 52.

Figure 2:
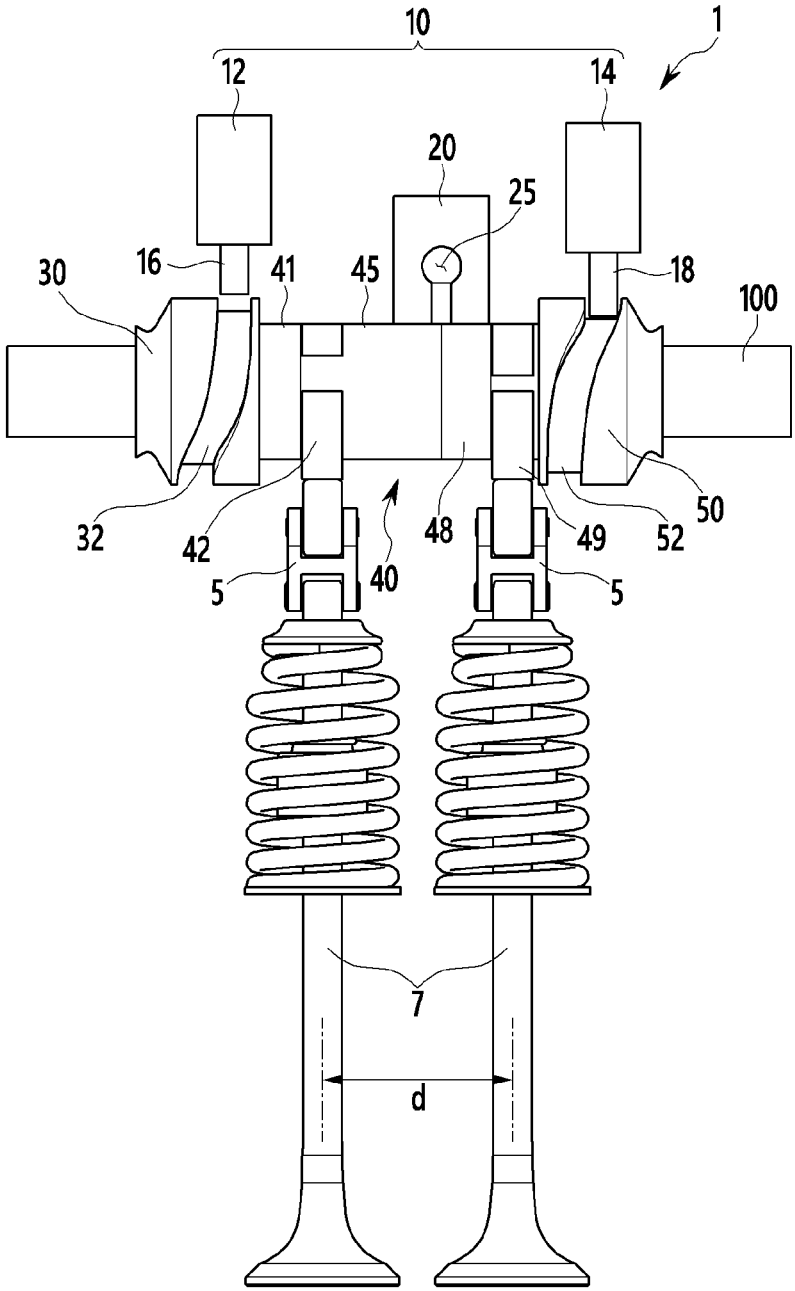
FIG. 2 illustrates an exemplary multiple variable valve lift apparatus according to the present invention on a state of realizing normal lift.

FIG. 2 illustrates a multiple variable valve lift apparatus according to various embodiments of the present invention on a state of realizing normal lift.

As shown in FIG. 1 and FIG. 2, a cam cap 20 is disposed to surround an external circumference of the journal 45 for preventing that the camshaft 100 is escaped by rotation of the cams 41, 42, 48, and 49.

In case the zero lift of the valve 7 is realized, the cam cap 20 is positioned on the exterior circumference of the journal 45, and in case the normal lift of the valve 7 is realized, the cam cap 20 is positioned on the exterior circumference of both the journal 45 and the second zero cam 48.

That is, as the journal 45 and the zero cam 41 and 48 have equal radius, the second zero cam 48 can be moved to be surrounded by the cam cap 20 without interference of the cam cap 20 when the normal lift of the valve 7.

An axial direction length of the journal 45 may be designed to be close a set thickness because the second zero cam 48 is moved to be surrounded by without interference with the cam cap 20. Therefore, the multiple variable valve lift apparatus 1 according to various embodiments of the present invention can be applied to an engine that a distance d between the two valves 7 which are disposed at one cylinder is narrow. Herein, the degree that the distance d between the two valves 7 is narrow may be close the sum of the thickness of the cam cap 20 and a thickness of one pair of cams 48 and 49.

Meanwhile, an oil passage 25 is formed at the cam cap 20 for lubrication of the cam 41, 42, 48, 49. In addition, oil is supplied to the exterior circumference of the journal 45 through the oil passage 25. Further, oil is also supplied to the exterior circumference of the second zero cam 48 when the normal lift of the valve 7 through the oil passage 25. Therefore, oil for lubrication is easily supplied to the lobe of the first normal cam 42 which is positioned to be close to the journal 45 and the lobe of the second normal cam 49 which is positioned to be close to the second zero cam 48.

According to various embodiments of the present invention, it is possible that an axial direction length of the journal 45 is reduced as a diameter of the journal 45 is equal to a diameter of the zero cam 48. In addition, fuel consumption can be improved as a multiple variable valve lift apparatus 1 is able to apply to a small engine having a narrow distance d between the two valves 7. Further, lubrication effect may be improved as oil is easily supplied to the lobe of the normal cam 42 and 49 through the oil passage 25 formed at the cam cap 20.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multiple variable valve lift apparatus comprising:

a camshaft rotating by driving of an engine;

a cam portion formed in a cylindrical shape having a hollow that the camshaft is inserted into, rotating together with the camshaft, configured to move along an axial direction of the camshaft, and forming a zero cam and a normal cam;

a valve opening/closing device including at least a valve and configured to be operated by at least one of the zero cam or the normal cam which are formed at the cam portion;

an operating device slidably disposed on an exterior circumference of the camshaft so as to move together with the cam portion; and a solenoid configured to selectively move the operating device along an axial direction of the camshaft, wherein a journal, which has a radius being equal to a radius of the zero cam, is formed at the cam portion such that a cam cap surrounds an exterior circumference thereof, wherein the cam cap is positioned to surround an exterior circumference of the zero cam in a case that the valve opening/closing device is operated by the normal cam.

2. The multiple variable valve lift apparatus of claim 1, wherein the operating device is formed in a cylinder shape having a hollow that the camshaft is inserted into.

3. The multiple variable valve lift apparatus of claim 2, wherein the operating device includes a guide rail formed at an external circumference of the operating device by a groove shape to be extended along the external circumference, wherein the solenoid includes an operating pin, which is selectively contacted to the guide rail, and wherein the guide rail is configured to guide such that the operating device is moved along the axial direction of the camshaft as the camshaft is rotated on a state that the operating pin contacts the guide rail.

4. The multiple variable valve lift apparatus of claim 1, wherein an oil passage is formed at the cam cap so as to supply oil for lubrication to an exterior circumference of the journal.

* * * * *